US010669616B2

(12) United States Patent
Parson et al.

(10) Patent No.: US 10,669,616 B2
(45) **Date of Patent: *Jun. 2, 2020**

(54) ALUMINUM ALLOY COMPOSITION AND METHOD

(71) Applicant: Rio Tinto Alcan International Limited, Montreal (CA)

(72) Inventors: Nicholas C. Parson, Kingston (CA); Raynald Guay, Jonquiere (CA); Alexandre Maltais, Chicoutimi (CA)

(73) Assignee: Rio Tinto Alcan International Limited, Montreal (CA)

( * ) Notice: Subject to any disclaimer, the term of this patent is extended or adjusted under 35 U.S.C. 154(b) by 703 days.

This patent is subject to a terminal disclaimer.

(21) Appl. No.: 14/033,057

(22) Filed: Sep. 20, 2013

(65) Prior Publication Data

US 2014/0083569 A1 Mar. 27, 2014

Related U.S. Application Data

(60) Provisional application No. 61/704,211, filed on Sep. 21, 2012.

(51) Int. Cl.
*C22F 1/04* (2006.01)
*C22C 21/00* (2006.01)

(52) U.S. Cl.
CPC ..... *C22F 1/04* (2013.01); *C22C 21/00* (2013.01)

(58) Field of Classification Search
CPC ..... C22F 1/04; C22C 21/00
See application file for complete search history.

(56) References Cited

U.S. PATENT DOCUMENTS 5,286,316 A 2/1994 Wade
6,284,386 B1 9/2001 Jeffrey et al.
6,458,224 B1 10/2002 Ren et al.
(Continued)

FOREIGN PATENT DOCUMENTS

CA 2493401 3/2004
CA 2510759 A1 7/2004
(Continued)

OTHER PUBLICATIONS

Davis, J.R. 'ASM Specialty Handbook: Aluminum and Aluminum Alloys', ASM International, 1993, p. 21, 44.*
(Continued)

*Primary Examiner* — George Wyszomierski
*Assistant Examiner* — Janell C Morillo
(74) *Attorney, Agent, or Firm* — Banner & Witcoff, Ltd.

(57) ABSTRACT

An aluminum alloy composition includes, in weight percent:
0.7-1.10 manganese;
0.05-0.25 iron;
0.21-0.30 silicon;
0.005-0.020 nickel;
0.10-0.20 titanium;
0.014 max copper; and
0.05 max zinc,
with the balance being aluminum and unavoidable impurities. The alloy may tolerate higher nickel contents than existing alloys, while providing increased corrosion resistance, as well as similar extrudability, strength, and performance. Billets of the alloy may be homogenized at 590-640° C. and controlled cooled at less than 250° C. per hour. The homogenized billet may be extruded into a product, such as an aluminum alloy heat exchanger tube.

30 Claims, 4 Drawing Sheets

(56) References Cited

U.S. PATENT DOCUMENTS

| | | | | |
|---|---|---|---|---|
| 6,638,376 | B2 | 10/2003 | Hasegawa et al. | |
| 6,908,520 | B2 * | 6/2005 | Taguchi ..... | C22F 1/04 148/689 |
| 6,939,417 | B2 | 9/2005 | Marois et al. | |
| 7,435,305 | B2 | 1/2008 | Shoji et al. | |
| 7,781,071 | B2 | 8/2010 | Parson et al. | |
| 8,025,748 | B2 | 9/2011 | Parson et al. | |
| 8,292,589 | B2 | 10/2012 | Koga | |
| 2001/0032688 | A1 | 10/2001 | Ren | |
| 2004/0154709 | A1 | 8/2004 | Taguchi et al. | |
| 2009/0301611 | A1 | 12/2009 | Parson et al. | |

FOREIGN PATENT DOCUMENTS

| | | | |
|---|---|---|---|
| CA | 2725837 | A1 | 12/2009 |
| DE | 102008056819 | B3 | 4/2010 |
| EP | 1564307 | A1 | 8/2005 |
| JP | 59193236 | A | 11/1984 |
| JP | H11172388 | | 6/1999 |
| JP | 2000119784 | | 4/2000 |
| WO | 9918250 | A1 | 4/1999 |
| WO | 2004057261 | A1 | 7/2004 |
| WO | 2013159233 | | 10/2013 |

OTHER PUBLICATIONS

ISR and WO dated Nov. 22, 2013 for PCT Application No. PCT/CA2013/050722.
Jul. 22, 2013—ISR App—PCT/CA2013/050320.
Sep. 2, 2014—IPRP—App PCT/CA2013/050320.

* cited by examiner

2a. Alloy A – 580°C

2b. Alloy B – 580°C

2c. Alloy C – 620°C

2d. Alloy D – 620°C

2e. Alloy C – 580°C

Table 2

Flow Stress and Conductivity Data

| Alloy | Mn | Fe | Si | Ti | Homo Temp °C | □f (MPa) | □□f % | IACS % |
|---|---|---|---|---|---|---|---|---|
| D | 0.78 | 0.11 | 0.23 | 0.17 | 620 | 20.3 | -1.5 | 36.2 |
| **A control** | **0.99** | **0.12** | **0.07** | **0.02** | **580** | **20.6** | **0** | **35.6** |
| C | 1.01 | 0.11 | 0.23 | 0.16 | 620 | 21.2 | 2.9 | 35.6 |
| D | 0.78 | 0.11 | 0.23 | 0.17 | 580 | 21.9 | 6.3 | 40.3 |
| C | 1.01 | 0.11 | 0.23 | 0.16 | 580 | 23.6 | 14.6 | 38.3 |

$\sigma_f$ = flow stress $\Delta\sigma_f$ = % difference in flow stress vs. Alloy A control

Figure 3

Table 3

MMP Tube Corrosion Results

| | | | | | | perf density (#/cm$^2$) | | |
|---|---|---|---|---|---|---|---|---|
| Alloy | Mn | Fe | Si | Ti | Homo Temp C | 5 days | 10 days | 15 days |
| A control | 0.99 | 0.12 | 0.07 | 0.02 | 580 | 0 | 0 | 0.09 |
| D | 0.78 | 0.11 | 0.23 | 0.17 | 620 | 0 | 0 | 0.14 |
| C | 1.01 | 0.11 | 0.23 | 0.16 | 620 | 0.02 | 0.11 | 0.23 |
| B | 0.98 | 0.11 | 0.09 | 0.02 | 580 | 0.03 | 0.23 | 0.52 |

Figure 4

Table 4
Grain Size

| Alloy | Mn | Fe | Si | Ti | Homo Temp C | Thru Thickness Grain Size □ |
|---|---|---|---|---|---|---|
| B | 0.98 | 0.11 | 0.09 | 0.02 | 580 | 51 |
| **A control** | **0.99** | **0.12** | **0.07** | **0.02** | **580** | **53** |
| C | 1.01 | 0.11 | 0.23 | 0.16 | 620 | 53 |
| D | 0.78 | 0.11 | 0.23 | 0.17 | 620 | 59 |
| C | 1.01 | 0.11 | 0.23 | 0.16 | 580 | 112 |

Figure 5

Table 5
Tensile Properties

| Alloy | Homogenisation Temp. °C | Yield Strength (MPa) | Tensile Strength (MPa) | Elongation % |
|---|---|---|---|---|
| A control | 580 | 35 | 90 | 34 |
| C | 620 | 36 | 93 | 38 |
| D | 620 | 31 | 88 | 37 |

Figure 6

ALUMINUM ALLOY COMPOSITION AND METHOD

CROSS-REFERENCE TO RELATED APPLICATION

The present application claims priority to and is a non-provisional of U.S. Provisional Application Ser. No. 61/704,211, filed Sep. 21, 2012, which is incorporated by reference herein in its entirety and made part hereof.

TECHNICAL FIELD

The invention relates generally to an aluminum alloy composition and methods of manufacturing and/or homogenizing that can be used with the composition, and more specifically, to an Al—Mn—Si—Ti alloy composition with good corrosion resistance and extrudability, as well as tolerance to increased Ni impurity levels.

BACKGROUND

The use of aluminum in heat exchangers is now widespread in applications such as automotive, off road equipment and heating ventilation and air conditioning (HVAC) systems. Extruded tubing is often used due to the ability to produce complex thin wall geometries such as mini microport (MMP) tubing which improves heat transfer. Such tubes are typically connected to fins and headers/manifolds to create the heat exchanger using controlled atmosphere brazing (CAB). Resistance to failure by pitting corrosion is an important property of these units which can be subjected to corrosive environments such as road salt, coastal environments and industrial pollutants. At the same time, the expectations in terms of lifetimes of the units and customer warranties are increasing and there is a continuing need to improve the corrosion performance of such systems. The extruded tubing is typically the thinnest walled component of such heat exchangers and the most likely to fail by corrosion first. Often the tubes are zincated either by thermal arc spray or by roll coating with a zinc containing flux which adds a measure of sacrificial corrosion protection. However, the inherent corrosion resistance of the underlying tube material remains a key component of the protection mechanism, particularly when the sacrificial Zn rich layer has been removed by corrosion.

A number of "long-life alloys" have been developed in an attempt to address this problem. U.S. Pat. No. 6,939,417 describes controlling the levels of Cu and Ni when using AA3000 and AA1000 series aluminum alloys to improve corrosion resistance. This patent is incorporated by reference herein in its entirety and made part hereof.

U.S. Pat. No. 5,286,316 provides an essentially copper free aluminum based alloy composition useful in automotive applications, in particular, heat exchanger tubing and finstock.

U.S. Pat. No. 6,638,376 relates to an aluminum alloy piping material exhibiting good corrosion resistance and having an excellent workability, such as bulge formation capability at the pipe ends.

U.S. Pat. No. 7,781,071 relates to extruded tubes for heat exchangers having improved corrosion resistance when used alone and when part of a brazed heat exchanger assembly with compatible finstock. This patent is incorporated by reference herein in its entirety and made part hereof.

U.S. Pat. No. 8,025,748 teaches an extrudable aluminum alloy ingot with 0.90-1.30Mn, 0.05-0.25Fe, 0.05-0.25 Si, 0.01-0.02Ti, less than 0.01Cu, less than 0.01Ni and less than 0.05 magnesium, with the aluminum alloy billet homogenized at a temperature ranging between 550 and 600° C. This product has been successful commercially, but further improvements in corrosion resistance are required for the demanding HVAC market. At the same time, availability of primary aluminum with low Ni content is decreasing globally causing a general degradation of pitting corrosion resistance.

The present composition and method are provided to address the problems discussed above and other problems, and to provide advantages and aspects not provided by prior compositions and methods of this type. A full discussion of the features and advantages of the present invention is deferred to the following detailed description, which proceeds with reference to the accompanying drawings.

BRIEF SUMMARY

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Aspects of the invention relate to an aluminum alloy composition that includes, in weight percent:

0.7-1.10 manganese;
0.05-0.25 iron;
0.21-0.30 silicon;
0.005-0.020 nickel;
0.10-0.20 titanium;
0.014 max copper; and
0.05 max zinc, with the balance being aluminum and unavoidable impurities. The impurities may be present in up to 0.05 wt. % each and 0.15 wt. % total, according to one aspect. The alloy may tolerate higher nickel contents than existing alloys, while providing increased corrosion resistance, as well as similar extrudability, strength, and performance. The alloy may tolerate nickel contents of 0.008-0.020 wt. %, according to another aspect. According to further aspects, the alloy may include a silicon content of 0.21-0.26 wt. %, a titanium content of 0.10-0.16 wt. %, and/or a manganese content of 0.75-1.05 wt. %.

Additional aspects of the invention relate to a method for processing a billet of an aluminum alloy as described above. The billet is homogenized at a homogenization temperature of 590-640° C. and then controlled cooled after homogenizing at a rate less than 250° C. per hour. The homogenized and controlled cooled billet can then be extruded to form an extruded aluminum alloy product, such as a heat exchanger tube.

According to one aspect, the homogenization temperature may be 600-640° C. or 610-640° C., and the billet may be homogenized for up to eight hours.

According to another aspect, the homogenized and controlled cooled billet has a flow stress at 500° C., at a strain rate of 0.1/sec, of 22 MPa or less.

According to a further aspect, the rate of the controlled cooling is less than 200° C. per hour, and the billet may be controlled cooled until it reaches room temperature or until it reaches between 300 and 400° C.

Further aspects of the invention relate to a product, such as an extruded aluminum alloy heat exchanger tube, formed at least partially of an aluminum alloy as described above. The aluminum alloy heat exchanger extruded tube may be extruded from a billet of the aluminum alloy and homogenized at a homogenization temperature of 590-640° C. before extrusion. The billet may also be controlled cooled at a rate less than 250° C. per hour after homogenization. Such a heat exchanger tube may also have a zinc diffusion layer applied at the external surface, for example, by thermal arc spray (e.g., as the extrusion emerges from the die) or a zinc-containing braze flux applied to the tube surface after extrusion (e.g., by roll coating). The alloy may additionally or alternately be clad with a brazing alloy.

According to one aspect, the tube exhibits a post-braze, through-thickness grain size of 100 microns or less. The grain size may be 75 microns or less, or about 50 microns, according to other aspects.

According to further aspects, the extruded aluminum alloy heat exchanger tube may have a post brazed tensile strength of at least 70 MPa.

Other features and advantages of the invention will be apparent from the following description.

BRIEF DESCRIPTION OF THE DRAWINGS

FIG. 3 shows Table 2, which reports flow stress and conductivity data for alloys tested in Example 1 herein;

FIG. 4 shows Table 3, which reports corrosion testing results for mini-microport (MMP) tubes tested in Example 2 herein;

FIG. 5 shows Table 4, which reports through-thickness grain sizes for alloys tested in Example 3 herein; and FIG. 6 shows Table 5, which reports tensile properties for alloys tested in Example 4 herein.

DETAILED DESCRIPTION

Figure 1:
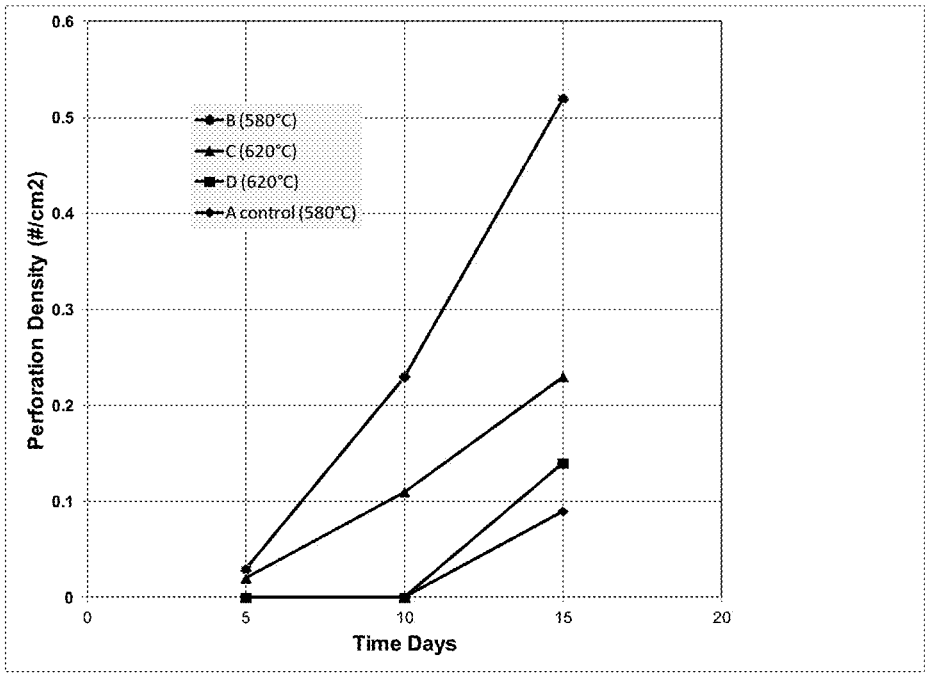
FIG. 1 is a graphical representation of Corrosion Data in Table 3 of Example 2, as shown in FIG. 4.

In general, a corrosion resistant Al—Mn—Si—Ti alloy composition is provided, which can be extruded into a heat exchanger tube while at the same time exhibiting tolerance to increased Ni impurity levels. The aluminum alloy enables increased corrosion resistance of extruded and brazed heat exchanger tubes. A method of manufacturing heat exchanger tubing or another article from such an alloy composition is also provided, including homogenizing the alloy composition prior to extrusion.

In one embodiment, an extrudable aluminum alloy composition may comprise, consist of, or consist essentially of, in weight percent:

Cu 0.014 max;
Fe 0.05-0.25;
Mn 0.7-1.1;
Ni 0.020 max or 0.001-0.020;
Si 0.21-0.30; and
Ti 0.10-0.20;

with the balance being aluminum and unavoidable impurities. Each unavoidable impurity is present at less than 0.05 wt. % and the total impurity content is less than 0.15 wt. %.

In one embodiment, zinc may be present in the alloy at less than 0.05 wt. %, and in other embodiments, the zinc content may be less than 0.03 wt. % or less than 0.01 wt. %. In another embodiment, the alloy is free or essentially free of zinc, and/or may have no intentional or deliberate addition of zinc.

In one embodiment, the copper content of the alloy may be less than 0.010 wt. %. In another embodiment, the alloy may be free or essentially free of copper, and/or may have no intentional or deliberate addition of copper.

In one embodiment, the iron content of the alloy may be 0.05-0.15 wt. %. Additionally, in one embodiment, the manganese content of the alloy may be 0.75-1.05 or 0.75-0.95 wt. %. Further, in one embodiment, the titanium content of the alloy may be 0.10-0.17 or 0.10-0.16 wt. %. In another embodiment, the titanium content may be 0.14-0.20 wt. %.

As mentioned above, the alloy can have increased tolerance to Ni impurity levels compared to other alloys. In one embodiment, the nickel content of the alloy may be 0.001-0.015 wt. %. In another embodiment, the lower limit for Ni in the alloy is 0.005 wt. %, and the Ni content may be 0.005-0.020 wt. %, or 0.005-0.015 wt. %. In yet another embodiment, the lower limit for Ni in the alloy is 0.008 wt. %, and the Ni content may be 0.008-0.020 wt. %, or 0.008-0.015 wt. %. In a further embodiment, the lower limit for Ni in the alloy is 0.010 wt. %, and the Ni content may be 0.010-0.020 wt. %, or 0.010-0.015 wt. %.

In another embodiment, the silicon content of the alloy may be 0.21-0.28 wt. %, 0.21-0.26 wt. %, or 0.21-0.25 wt. %. In a further embodiment, the silicon content of the alloy may be 0.26-0.30 wt. %.

The aluminum alloy composition according to some embodiments is particularly suitable for making extruded heat exchanger tubing.

A method for manufacturing heat exchanger tubing or another article from an alloy composition as described above may include homogenization of the alloy prior to extrusion into heat exchanger tubing. The alloy may be used in forming a variety of different articles, and may be initially produced as a billet. The term "billet" as used herein may refer to traditional billets, as well as ingots and other intermediate products that may be produced via a variety of techniques, including casting techniques such as continuous or semi-continuous casting and others.

In one embodiment, the aluminum alloy composition, in for example the form of a billet or ingot, is homogenized at temperatures from 590 to 640° C. In another embodiment, the homogenization temperature may be 600 to 640° C. or 610 to 640° C. Homogenization may be carried out for up to 8 hours in one embodiment or up to 4 hours in another embodiment. The homogenization may be carried out for at least 1 hour in one embodiment.

After homogenization, the homogenized billet may then be controlled cooled at a rate less than 250° C./hr in one embodiment, less than 200° C./hr in another embodiment, or less than 150° C./hr in a further embodiment. This controlled cooling may be performed until the billet reaches room temperature in one embodiment, or until the billet reaches 300° C. or 400° C. in other embodiments.

The electrical conductivity of the billet after homogenization may be 33-40% IACS or 33-38% IACS (International Annealed Copper Standard) in one embodiment.

In an embodiment, the billet after homogenization has a flow stress at 500° C. at a strain rate of 0.1/sec of 22 MPa or less, or 21 MPa or less in another embodiment.

After homogenization, the billet can be formed into an article of manufacture using various metal processing techniques, such as extrusion, forging, rolling, machining, casting, etc. For example, extruded articles may be produced by extruding the billet to form the extruded article. It is understood that an extruded article may have a constant cross section in one embodiment, and may be further processed to change the shape or form of the article, such as by cutting, machining, connecting other components, or other techniques. As described above, the billet may be extruded to form heat exchanger tubing or other tubing in one embodiment, and the tubing may have a diffusion surface layer applied or be clad in various other metals. For example, the tubing may have a zinc diffusion layer, e.g., applied by either thermal arc spraying or a zinc containing flux, or may be clad in a brazing alloy, or other cladding materials. The tubing may then be brazed or welded to another component of the heat exchanger.

In an embodiment, post-brazed tubes made of the alloy of the present invention have a post brazed tensile strength of at least 70 MPa.

Alloys according to the embodiments described above utilize a titanium addition to improve the corrosion resistance through a peritectic segregation layering mechanism. During solidification, the titanium atoms segregate preferentially towards the dendrite centers, resulting in a composition distribution across the microstructure including alternating areas of higher and lower Ti content, on the scale of the dendrite arm spacing, e.g., 20-80 microns in one embodiment (which may depend on the billet diameter). Measurements made on the billet structure indicate that titanium levels can vary from almost zero at areas of lowest concentration to about 0.40 wt % areas of highest concentration within the alloy. Extrusion of this structure results in alternating bands or lamellae of high and low titanium concentration material parallel to the tube surface. Generally, the bands or lamellae may have thicknesses and spacing that are significantly less than the dendrite arm spacing, depending on extrusion ratio. Without being bound by theory, it is believed that this inhibits pitting by promoting lateral attack parallel to the tube surface, when used as heat exchanger tubing. However, the titanium addition is mainly in solid solution in the microstructure. This can significantly increase the flow stress at extrusion temperature and limit the extrusion speed and die life. A combination of the silicon addition and the homogenization treatment described above was found to provide a flow stress and processability similar to current commercial long-life tubing alloys. The modified alloy/homogenization also produces a fine grain structure after brazing, which is beneficial for corrosion resistance. In one embodiment, the alloy after extrusion and brazing exhibits a through-thickness grain size of 100 microns or less. In other embodiments, the through-thickness grain size may be 75 microns or less, or about 50 microns. The linear intercept method is one suitable method for determining this grain size.

Several experiments were conducted including alloys according to aspects and embodiments described herein. Such experiments are described below in Examples 1-4.

Example 1

High Temperature Flow Stress

The alloys in Table 1 were DC cast as 101-mm diameter extrusion ingots. Ingot slices were homogenized for 4 hours at either 580 or 620° C. (as noted in Table 2, shown in FIG. 3) and cooled at <250° C./hr to 300° C.

TABLE 1

| | Alloy Compositions | | | |
|---|---|---|---|---|
| | A | B | C | D |
| Si | 0.07 | 0.09 | 0.23 | 0.23 |
| Fe | 0.12 | 0.11 | 0.11 | 0.11 |
| Cu | <.01 | <.01 | <.01 | <.01 |

TABLE 1-continued

| | Alloy Compositions | | | |
|---|---|---|---|---|
| | A | B | C | D |
| Mn | 0.99 | 0.98 | 1.01 | 0.78 |
| Mg | <.01 | <.01 | <.01 | <.01 |
| Ni | 0.001 | 0.008 | 0.006 | 0.006 |
| Zn | 0.02 | <.01 | <.01 | <.01 |
| Ti | 0.02 | 0.02 | 0.16 | 0.17 |

Samples of 10 mm dia. and 15 mm in length were machined and tested under plane strain compression at an applied strain rate of 0.1/s and a test temperature of 500° C. The maximum load was captured and the peak flow stress calculated. The flow stress is an indicator of extrusion pressure which in turn is an indicator of ease of extrusion. An alloy with a lower flow stress can be extruded faster for a given extrusion press and tube profile. The majority of the work done in extrusion is converted to heat which raises the temperature of the extruded profile and the tooling. A material with a lower flow stress results in a lower surface temperature for the extruded product and the die, thus giving better surface finish and longer die life. Electrical conductivity of the homogenized ingot was measured by an eddy current probe. The flow stress and conductivity values are tabulated in Table 2, shown in FIG. 3, where the data is ranked in terms of increasing flow stress.

Alloy A (control) is an example of a successful long-life alloy currently in commercial use for extruded heat exchanger tubing, as described by U.S. Pat. No. 8,025,748. The alloy is typically homogenized below 600° C. to produce a fine Al—Mn—Si dispersoid distribution which gives a reduced flow stress and inhibits recrystallisation during brazing, such that a tube wall with a fine grain size can be produced, which is beneficial to corrosion resistance. The alloy has a flow stress low enough to allow it to be extruded into thin wall MMP profiles with acceptable productivity and die life. Any alternative alloy with improved corrosion performance would need to have a flow stress close to this value. Alloy C with an addition of 0.16 wt. % Ti and 0.23 wt. % Si, homogenized at 580° C., gave a flow stress ~15% higher than the control. Even dropping the Mn content to ~0.8 wt. %, as per Alloy D, still gave a flow stress ~6% higher than the control. However, the combination of the Si addition in Alloys C and D combined with the use of a homogenization temperature >600° C., resulted in flow stress values close to, or even below, that of the control alloy. Alloy B was not tested, as the composition was essentially the same as the control alloy, and the slight increase in Ni content is not expected to affect flow stress, as this element partitions strongly to the iron rich constituent particles.

Example 2

Corrosion Resistance

Billets of Alloys A and B as described above were homogenized for 4 hours at 580° C., as described in U.S. Pat. No. 8,025,748, issued Sep. 27, 2011, which is incorporated by reference herein in its entirety and made part hereof. Alloys C and D as described above were homogenized for 4 hrs/620° C. (which produced beneficial results in reducing high temperature flow stress in Example 1). The billets were cooled at <250° C./hr down to 300° C. The billets were then extruded on an 780-tonne extrusion press using a billet temperature of 520° C. and a ram speed of 4 mm/s into a MMP hollow profile with a wall thickness of 0.35 mm at an extrusion ratio of 480/1. The tube was water quenched on leaving the die to simulate industrial practice. The tube was cut into 100-mm coupons, which were degreased and cold rolled to give a 4% thickness reduction (to simulate commercial sizing practice). A thermal treatment was then applied for 120 seconds at 600° C. to simulate a typical CAB braze cycle. The coupons were then exposed in a corrosion cabinet to a SWAAT environment (ASTM G85 A3). A total of 12 coupons per alloy were exposed and 4 samples of each alloy were removed after 5, 10 and 15 days exposure. The tubes were pressure tested under water to identify any leaks and once the samples had failed, the leak density per unit area was calculated. The corrosion results are presented in Table 3 shown in FIG. 4, and are presented graphically in FIG. 1. The results are ranked in terms of decreasing corrosion resistance in Table 3.

Alloy A, which is the example of a successful current long-life alloy, exhibited the first failure at 15 days and gave the lowest perforation density. Alloy B, which is the same composition as Alloy A, other than a higher Ni impurity level, failed in 5 days and consistently gave the highest perforation density, showing the detrimental effect of Ni on pitting corrosion. Alloys C and D, also containing increased Ni impurity levels, homogenized at the high temperature practice, gave superior corrosion behaviour than Alloy B and were closer to Alloy A in terms of performance. This was particularly the case for Alloy D.

Example 3

Grain Structure

Figure 2:
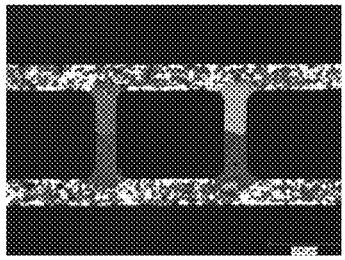
FIG. 2 shows the Transverse Grain Structures after Sizing and Braze Simulation of alloys A, B, C and D of Example 3.
Figure 2:
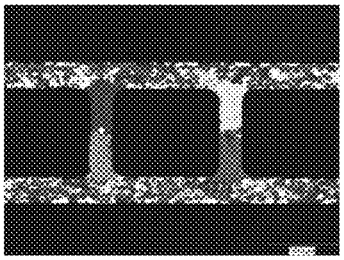
Figure 2:
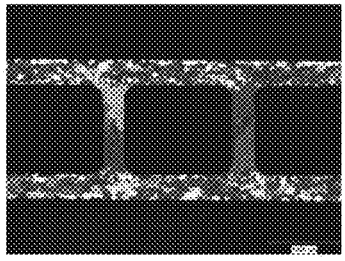
Figure 2:
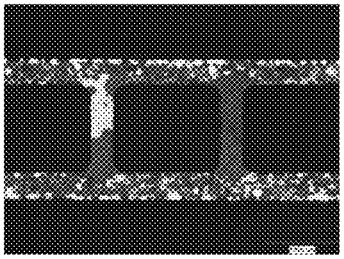
Figure 2:
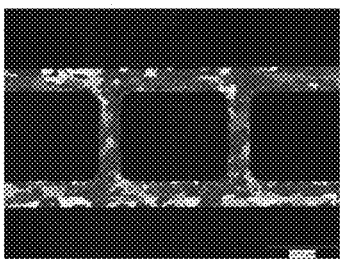

A fine equiaxed grain structure is preferred after brazing for superior corrosion resistance. FIG. 2 shows the transverse grain structure of the cold worked and brazed tubes prior to exposure in the corrosion test. Table 4, shown in FIG. 5, illustrates the through-wall thickness grain size values measured from the micrographs in FIG. 2 using the linear intercept method.

Alloys A and B exhibit the typical fine grain structure in the tube wall taught by U.S. Pat. No. 8,025,748. The tube webs of Alloys A and B exhibit coarse grain as the cold work from sizing is concentrated in these regions, thus causing recrystallisation during the braze cycle. The fine grain in the tube wall is the residual as-extruded structure, and this structure survives the braze cycle due to the presence of the manganese dispersoid structure formed during homogenization which "pins" the grain boundaries and inhibits recrystallisation. Surprisingly, Alloys C and D, homogenized at 620° C., which produced reduced flow stress in Example 1, also exhibit the preferred fine grain structure. However, Alloy C, when homogenized at 580° C., exhibited an undesirable coarse grain structure, offering a less convoluted path through the wall thickness for corrosion.

Example 4

Mechanical Properties

Tensile properties for the extruded, sized and brazed tubing as described above are reported in Table 5, shown in FIG. 6. The modified Alloys C and D gave similar mechanical properties to the commercially successful Alloy A, indicating they are suitable for heat transfer applications.

Having regard to the above specific examples, it appears that Alloys C and D, when combined with homogenization at 620° C., overcome the problem of achieving good corrosion resistance at higher nickel impurity levels while still maintaining good extrudability, as well as having a fine post brazed grain structure and acceptable mechanical properties for heat transfer applications.

The alloy composition of the present invention may be used advantageously wherever corrosion resistance is required, particularly when combined with the homogenization treatment as described above. This includes not only the production of extruded and brazed heat exchanger tubing, but also non-brazed heat exchanger tubing and general extrusion applications, as well as sheet products, including tube manufactured from folded sheet, in various embodiments. The alloy can be extruded at similar production rates as existing commercial extrusion alloys. The alloy also exhibits tolerance to increased Ni impurity levels. Still other benefits and advantages are recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims. All compositions herein are expressed in weight percent, unless otherwise noted. It is understood that any of the ranges (e.g., compositions) described herein may vary outside the exact ranges described herein, such as by up to 5% of the nominal range endpoint, without departing from the present invention. In one embodiment, the term "about" may be used to indicate such variation.

What is claimed is:

1. An extruded product formed at least partially of an aluminum alloy composition consisting essentially of, in weight percent:

0.7-1.10 manganese;
0.05-0.25 iron;
0.21-0.30 silicon;
0.005-0.020 nickel;
0.10-0.20 titanium;
0.014 max copper; and
0.05 max zinc,
with the balance being aluminum and unavoidable impurities,
wherein the extruded product is extruded from a billet homogenized at a homogenization temperature of 590-640° C. before extrusion, and
wherein the extruded product exhibits a post-braze, through-thickness grain size of 100 microns or less.

2. The extruded product as claimed in claim 1, wherein the silicon content of the aluminum alloy composition, in weight percent, is 0.21-0.26.

3. The extruded product as claimed in claim 1, wherein the titanium content of the aluminum alloy composition, in weight percent, is 0.10-0.16.

4. The extruded product as claimed in claim 1, wherein the nickel content of the aluminum alloy composition, in weight percent, is 0.008-0.020.

5. The extruded product as claimed in claim 1, wherein the silicon content of the aluminum alloy composition, in weight percent, is 0.21-0.26, the titanium content of the aluminum alloy composition, in weight percent, is 0.10-0.16, and the nickel content of the aluminum alloy composition, in weight percent, is 0.008-0.020.

6. The extruded product as claimed in claim 1, wherein the manganese content of the aluminum alloy composition, in weight percent, is 0.75-1.05.

7. The extruded product as claimed in claim 1, wherein impurity content of the aluminum alloy composition, in weight percent, is no more than 0.05 per impurity and 0.15 total.

8. The extruded product as claimed in claim 1, wherein the extruded product has a microstructure with alternating bands of higher titanium content material and lower titanium content material oriented parallel to a surface of the product.

9. The extruded product as claimed in claim 1, wherein the post-braze, through-thickness grain size is 75 microns or less.

10. The extruded product as claimed in claim 9, wherein the post-braze, through-thickness grain size is about 50 microns.

11. The extruded product as claimed in claim 1, wherein the extruded product is brazed, and the extruded product has a post brazed tensile strength of at least 70 MPa.

12. The extruded product as claimed in claim 1, wherein the extruded product is a heat exchanger tube with multiple channels extending along an extrusion direction.

13. The extruded product as claimed in claim 1, wherein the extruded product has a wall thickness no greater than 0.35 mm.

14. The extruded product as claimed in claim 1, wherein the extruded product is a heat exchanger tube having a wall thickness no greater than 0.35 mm, and wherein impurity content of the aluminum alloy composition, in weight percent, is no more than 0.05 per impurity and 0.15 total.

15. A method comprising:

casting a billet of an aluminum alloy composition consisting essentially of, in weight percent, 0.7-1.10 manganese, 0.05-0.25 iron, 0.21-0.30 silicon, 0.005-0.020 nickel, 0.10-0.20 titanium, 0.014 max copper, and 0.05 max zinc, with the balance being aluminum and unavoidable impurities;

homogenizing the billet at a homogenization temperature of 590-640° C.;

controlled cooling the billet after homogenizing at a rate less than 250° C. per hour; and extruding the homogenized and controlled cooled billet to form an extruded aluminum alloy product, wherein the extruded aluminum alloy product exhibits a post-braze, through-thickness grain size of 100 microns or less.

16. The method as claimed in claim 15, wherein the homogenization temperature is 610-640° C., and wherein the billet is homogenized for up to eight hours.

17. The method as claimed in claim 15, wherein the homogenized and controlled cooled billet has a flow stress at 500° C., at a strain rate of 0.1/sec, of 22 MPa or less.

18. The method as claimed in claim 15, wherein the rate of the controlled cooling is less than 200° C. per hour.

19. The method as claimed in claim 15, wherein the billet is controlled cooled to room temperature.

20. The method as claimed in claim 15, wherein the billet is controlled cooled to between 300 and 400° C.

21. The method as claimed in claim 15, wherein the silicon content of the aluminum alloy composition, in weight percent, is 0.21-0.26, the titanium content of the aluminum alloy composition, in weight percent, is 0.10-0.16, and the nickel content of the aluminum alloy composition, in weight percent, is 0.008-0.020.

22. The method as claimed in claim 15, wherein the homogenized billet has an electrical conductivity of 33-40% IACS.

23. An extruded aluminum alloy heat exchanger tube having multiple channels extending along an extrusion direction and formed at least partially of an aluminum alloy consisting essentially of, in weight percent, 0.7-1.10 manganese, 0.05-0.25 iron, 0.21-0.30 silicon, 0.005-0.020 nickel, 0.10-0.20 titanium, 0.014 max copper, and 0.05 max zinc, with the balance being aluminum and unavoidable impurities, wherein the extruded aluminum alloy heat exchanger tube is extruded from a billet homogenized at a homogenization temperature of 590-640° C. before extrusion, and wherein the tube exhibits a post-braze, through-thickness grain size of 100 microns or less.

24. The extruded aluminum alloy heat exchanger tube as claimed in claim 23, wherein the billet is controlled cooled at a rate less than 250° C. per hour after homogenization.

25. The extruded aluminum alloy heat exchanger tube as claimed in claim 23, wherein the post-braze, through-thickness grain size is 75 microns or less.

26. The extruded aluminum alloy heat exchanger tube as claimed in claim 25, wherein the post-braze, through-thickness grain size is about 50 microns.

27. The extruded aluminum alloy heat exchanger tube as claimed in claim 23, wherein the silicon content of the aluminum alloy, in weight percent, is 0.21-0.26, the titanium content of the aluminum alloy, in weight percent, is 0.10-0.16, and the nickel content of the aluminum alloy, in weight percent, is 0.008-0.020.

28. The extruded aluminum alloy heat exchanger tube as claimed in claim 23, wherein the tube is brazed, and the tube has a post brazed tensile strength of at least 70 MPa.

29. The extruded aluminum alloy heat exchanger tube as claimed in claim 23, wherein the tube has a microstructure with alternating bands of higher titanium content material and lower titanium content material oriented parallel to a surface of the tube.

30. The extruded aluminum alloy heat exchanger tube as claimed in claim 23, wherein the extruded aluminum alloy heat exchanger tube has a wall thickness no greater than 0.35 mm.

* * * * *